United States Patent [19]

Bell

[11] Patent Number: 4,889,448

[45] Date of Patent: Dec. 26, 1989

[54] TUNNEL CONSTRUCTION

[76] Inventor: Noel G. Bell, 52 W. Hudson Ave., Englewood, N.J. 07631

[21] Appl. No.: 319,660

[22] Filed: Mar. 7, 1989

[51] Int. Cl.[4] ..... E21D 10/14

[52] U.S. Cl. ..... 405/135; 405/136; 405/152

[58] Field of Search ..... 405/134–137, 405/152, 158, 166, 171; 138/89

[56] References Cited

U.S. PATENT DOCUMENTS

| | | | |
|---|---|---|---|
| 715,768 | 12/1902 | Dunham | 405/135 X |
| 1,678,127 | 7/1928 | Smith | 405/136 X |
| 3,005,314 | 10/1961 | Cunninghma | 405/134 X |
| 3,656,309 | 4/1972 | Bultema | 405/171 X |
| 4,075,855 | 2/1978 | Meldner | 405/152 |
| 4,522,532 | 6/1985 | Fedrick | 405/11 |
| 4,695,204 | 9/1987 | Bell | 405/283 |

*Primary Examiner*—Dennis L. Taylor
*Assistant Examiner*—Arlen L. Olsen

[57] ABSTRACT

A method of construction of tunnels under water by pre-fabricating them in short sections with their ends adapted to make fluid-tight joints with adjacent sections, transporting, sinking and joining them together and forming the sections into sets by installing a bulkhead in the last section of each set and dewatering the sets and tying the sections together.

6 Claims, 2 Drawing Sheets

TUNNEL CONSTRUCTION

BACKGROUND OF THE INVENTION

This invention refers to construction of tunnels of large diameter under water, for example those used for road and rail traffic.

Common existing methods of constructing tunnels under water are by boring and lining, and also by pre-fabricating them in long sections which are floated to site and sunk in a trench, the sections being generally of a length ten or more times the tunnel diameter and being constructed in a drydock or on a slipway.

Objects of the invention are to provide a simpler and faster method of construction of pre-fabricated tunnels without the use of divers and to reduce the size of open trench and the time it is open.

SUMMARY OF THE INVENTION

The invention provides a method of construction of tunnels by prefabricating them in short sections with their ends adapted to make fluid-tight joints with adjacent sections, transporting, sinking and joining them together and forming the sections into sets by installing a bulkhead in the last section of each set and dewatering the sets and tying the sections together.

BRIEF DESCRIPTION OF THE DRAWINGS

The following drawings show one embodiment of the invention, in this case a reinforced concrete tunnel:

FIG. 6 is a vertical long section.

FIG. 7 is a plan.

DESCRIPTION OF THE PREFERRED EMBODIMENT

Figures 1, 2, 3, 4, 5:
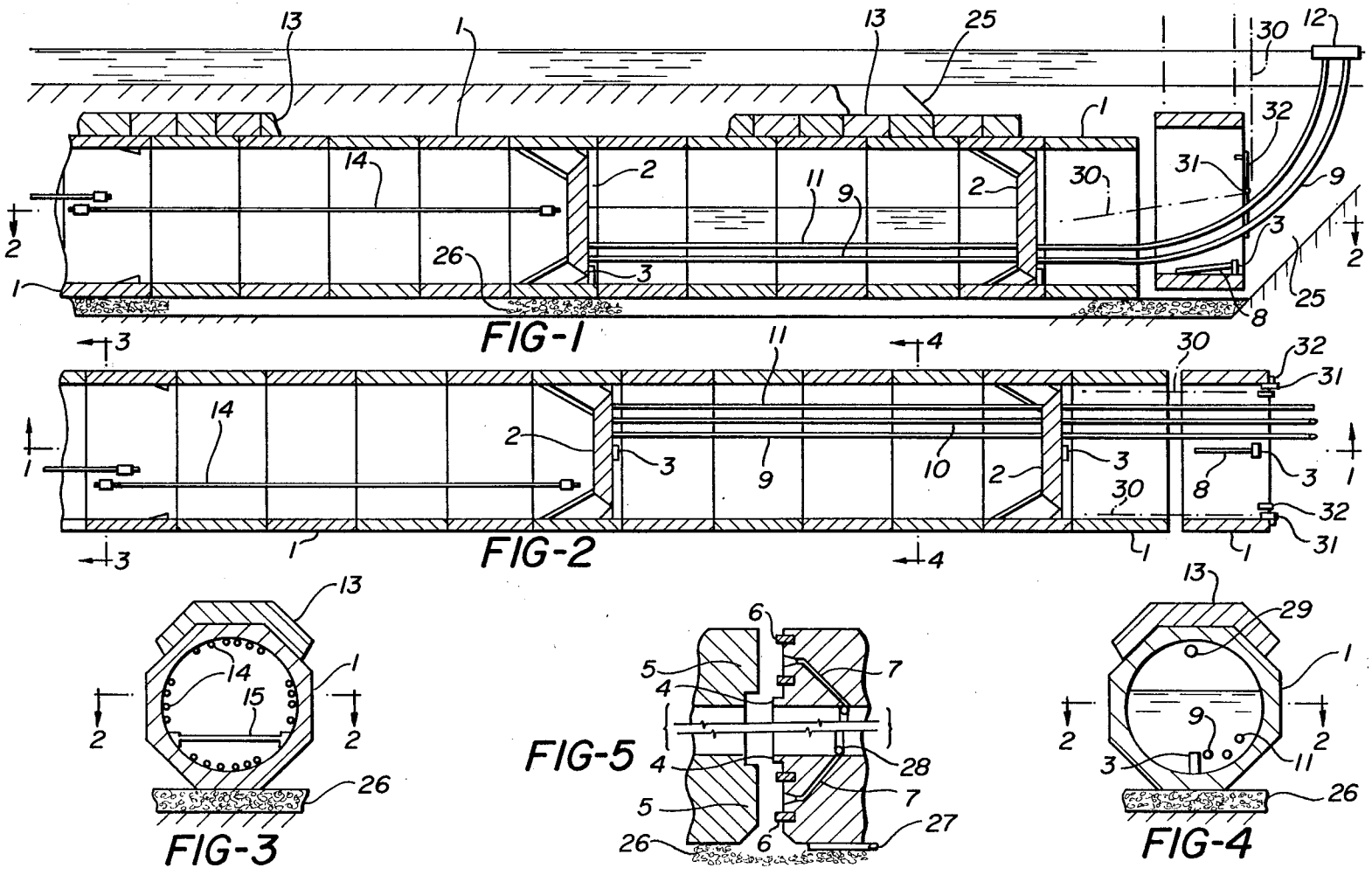
FIG. 1 is a vertical long section.
FIG. 2 is a horizontal long section.
FIG. 3 is a cross section.
FIG. 4 is another cross section.
FIG. 5 is a part enlarged cross section of the joint between sections, the joint shown just before closure.

A tunnel is constructed under water by pre-fabricating short sections of tunnel, of a length suitable for fabricating and transporting on land, with their ends adapted to make fluid-tight joints with adjacent sections 1, transporting the sections 1 to site and lowering them under water and joining them to those previously placed to form sets of a convenient number of sections 1, the sections having their ends open except the last one of a set which has a bulkhead 2 installed with a pump 3 attached to its front face to dewater the set.

The fluid-tight joint between the sections is of the bell 4 and spigot 5 type with a pair of circular gaskets 6 mounted on the face of the bell end to form a fluid-tight seal, and there are conduits 7 from the joint to the internal periphery of the section and to a circumferential pipe 28 that is connected by another conduit 8 to a pump 3 which can dewater the joint and allow the pressure of the water on the end of the section to close the joint. The spigot is slightly longer than the bell leaving a space for grouting the inside of the joint after the set is dewatered.

The pump 3 is placed in the section before the section is lowered under water and is connected by a slip joint to a hose 8 from the circumferential pipe 28 so that the pump which is connected by a power line to the surface can be hoisted tot the surface where the joint is closed. Non-return valves can be placed at the periphery on the conduits 7 from the joint. Closing the joint may be assisted by ropes 30 attached to the bulkhead last placed, or to another section, which lead thru sheaves 31 on temporary frames 32 on the section being placed and then lead to a power source on the surface. They may be placed at quarter points for better control.

If necessary, to make it easier to close the joint and avoid friction on the bottom of the section, the bedding material 26 might be screeded to a slightly lower level than finished grade. A row of longitudinal hoses 27 with width nozzles could be placed on the bottom of a section at suitable intervals before the section is lowered under water and be supported by brackets on the bottom of the section, the nozzles being mounted at the end to be joined and the hoses passing over a curved temporary frame at the other end of the section and reaching to the surface. After the joint is closed, sand slurry could be pumped thru the hoses to fill the void as the hoses were withdrawn.

Before the section with a bulkhead 2 is lowered under water, flexible conduits for air inlet 9 and exhaust 10 and a cable 11 for power and telephone which are connected to ports in the bulkhead last placed are passed thru ports with fluid-tight stuffing boxes in the new bulkhead and lead to a pontoon 12 on the surface. The power line from the pump 3 also leads to the pontoon which is floated thru each succeeding section as the section is being lowered until the next bulkhead is reached. By then the last set will have been pumped out and the power line to the pump can be pulled from its socket and removed. The pump can be removed when the bulkhead is dismantled. The procedure is repeated with the next bulkhead.

Before a set is pumped out weights 13 are placed on the sections to overcome buoyancy.

After the set is dewatered the bulkhead is dismantled and the sections are tied together, for example, in the case of reinforced concrete sections by post-tensioning tendons 14, and for other materials by bolting, riveting and welding.

Work can now proceed inside the tunnel such as grouting the conduits 7 at the periphery leading to the joint, and the inside of the joint at the bell, setting pre-cast road slab 15 and so forth while simultaneously placing new sections outside.

Figures 6, 7, 8, 9, 10:
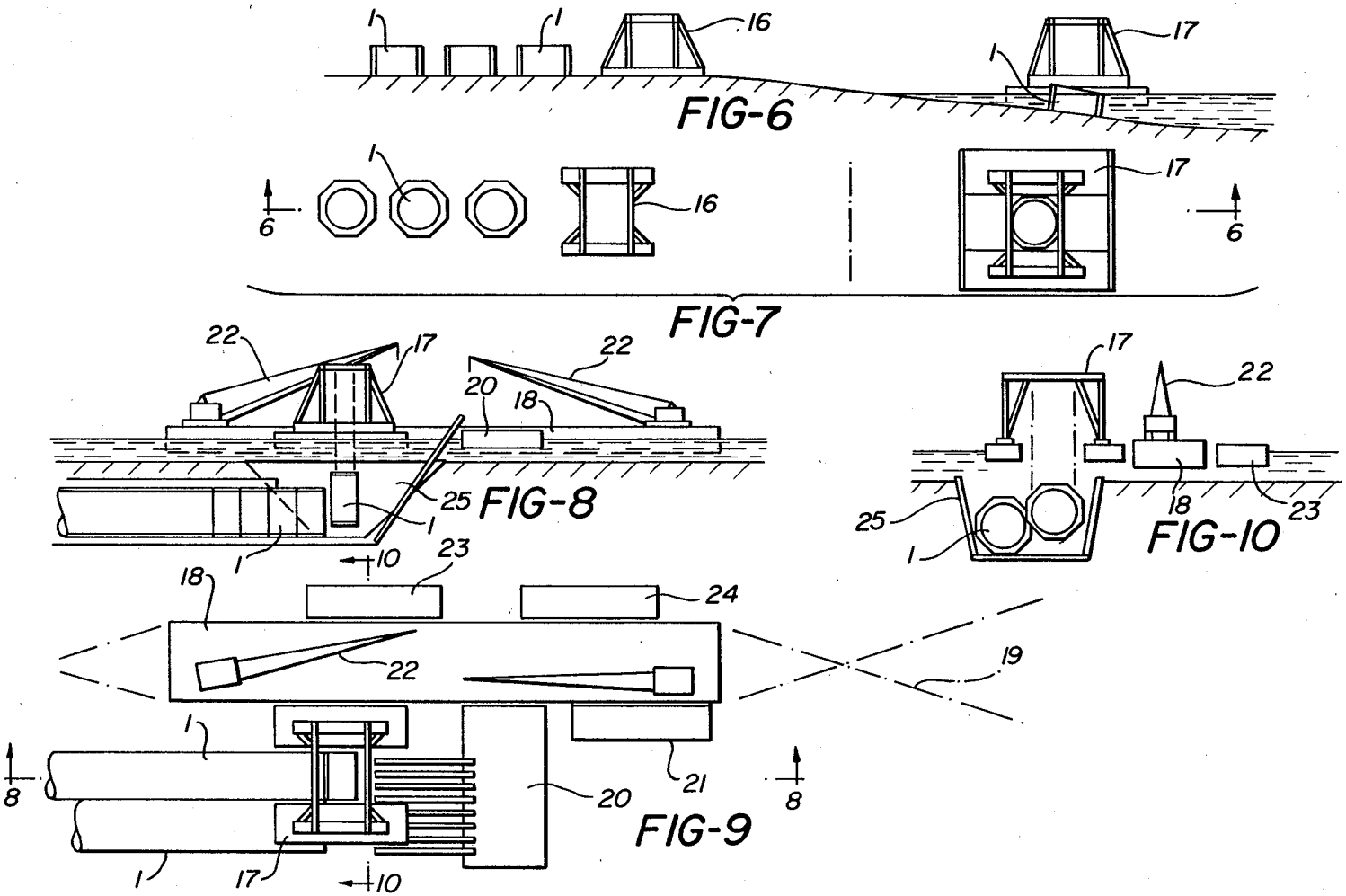
FIGS. 6 and 7 are views of a typical fabricating yard and FIGS. 8 thru 10 of a typical marine equipment layout.
FIG. 8 is a vertical long section.
FIG. 9 is a plan.
FIG. 10 is a cross section.

FIGS. 6 and 7 show a fabricating yard on land where a traveling gantry 16 transports the sections to water deep enough to float a catamaran 17 which carries the sections to the tunnel site shown in FIGS. 8, 9 and 10. There a carfloat 18 or long barge is moored in parallel alinement with the tunnel. The barge may have duplicate sets of mooring lines 19 so that it may always be held in alinement when moving anchors ahead, and the lines may be run thru sheaves at the bottom of the barge to afford more clearance for incoming craft. A dredge 20 is moored alongside the barge and has a mud scow 21 behind it. Cranes 22 on the barge handle negative buoyancy weights 13 from a scow 23 and bedding material 26 from another scow 24. A traveling trench shore 25 is shown in outline in FIGS. 8 and 10. A jack-up rig could be used instead of a barge if preferable.

A traveling trench shore 25 as described in my U.S. Pat. Nos. 4,695,204 and 4,547,097 or 4,548,528 may be used on the tunnel. Where it is used and the tunnel is on a curve the panels may be curved. The hydraulic jacks on the shore should have swivel pivot mounts.

If the shore is not needed or suitable, for example in hard ground or rock, a screed for grading bedding material can be employed. It could consist of a four legged frame, longer and slightly wider than a section, which supports a vertically adjustable frame parallel to the grade on which the screed blade travels. The frame can also be mounted on crawler tracks.

A tunnel could be started at the middle or an intermediate point by providing a large diameter access shaft on the first section sunk which could be of extra length and have bulkheads on both ends. A heavy jack-up rig could serve as a platform and supply station, and a hole could be excavated to receive a trench shore or a screed.

The above method might be used in the case of a long bored tunnel in homogeneous ground where a section of varied soils is encountered which are unsuitable for the boring machine. In this case the bore of the tunnel sections could be made larger to allow the boring machine to pass thru.

An alternative kind of fluid-tight joint between the sections is of the spigot and socket type which has circumferential gaskets in grooves on the outer periphery of the spigot and on the outer periphery of the inner lip of the socket, and has conduits from the joint to the internal periphery of the section for dewatering. However providing clearances for such a large diameter section would be difficult.

Another way of joining the sections with a bell and spigot joint is by the known method of placing a bulkhead with a pump attached on the end of the section being placed and pumping to reduce the pressure of the water in the set and thus allow the pressure on the outside to close the joint.

When the bulkhead is used in the last section of a set, in the manner previously described, the dewatering hose 8 is connected to the pump intake in the bulkhead, and a non-return valve 29 at the top of the bulkhead allows the water in the section to escape and also later prevents a vacuum when the set is pumped out. If the bulkhead is used to close the joint by the known method just mentioned, the non-return valve 29 is replaced by a normal valve which is closed before the section is lowered under water, and opened from the tunnel side as the water is pumped out.

Other particulars are as follows:

Instead of ropes, power jacks may be mounted on the section being placed to assist in closing the joint, the jacks having piston rods with hinged arms that bend upwards and whose ends are chamfered underneath which engage bosses on the last section placed and pull the new section into place. The jacks may be remote controlled.

If there were heavy swell or wave action at the site, the method of lowering the sections on water filled bags might be used.

Only the minimum number of weights to overcome buoyancy should be placed until after post-tensioning, to minimize friction on the bottom of the sections in case some joints need tightening.

If joints need tightening, they could be tightened progressively with sets of four extra heavy tendons, all the tendons being left in place till the normal tendons are installed, when the temporary ones can be removed.

Diametrically opposite post-tensioning tendons should be stressed simultaneously.

A coating of epoxy or similar material should be applied to the contacting face, of the joint between the sections.

Pipes with valves may be placed in the bottom of sections for grouting if necessary.

A short fairlead may be mounted on the inside of the end of a section to aid in making the joint.

A temporary cover may be placed over the lower open end of a section to keep out dirt.

The bottom of the sections should be chambered at the joints to avoid draging dirt into the joints.

The traveling gantry 16 in the casting yard may travel on rail track extending under water, with a pair of four wheel bogies under each corner to spread the load.

The joints between sections could also be dewatered by conduits on the outer periphery of the section.

As there is extra clearance between the bell and the spigot of the joint because of the large diameter of the sections, a gasket of larger size and softer material could be placed on the bell to give more leak protection.

A screw jack could be placed at the end of the struts from the periphery to the bulkhead for easier dismantling.

Twin tunnels may have cross connections at suitable intervals.

Under water television cameras and lights may be used if needed.

Any of the methods of construction described for under water tunnels may be applied where suitable in the construction of the semi-immersed or land approaches to an under water tunnel, for example, the pumping out of the fluid-tight joints between the sections to join them, or tying them together with post-tensioning tendons, but without the need for bulkheads on the land portión.

I claim:

1. A method of constructing tunnel under water by pre-fabricating short sections of tunnel, making the length of the sections suitable for fabricating and transporting on land and adapting their ends to make a fluid-tight joints with adjacent sections, transporting a section to site with its ends open and lowering it into position under water and then transporting and lowering succeeding sections with their ends open and joining them to those previously placed to form sets of a convenient number of sections, installing a bulkhead in the last section of a set and attaching a pump to the bulkhead to dewater the set, dewatering the set of tunnel sections and, allowing working inside the tunnel, for example tying the sections of tunnel together, grouting joints, placing roadway slabs and installing ventilation and lighting systems, to proceed simultaneously with the placing of sections outside.

2. A method of constructing tunnels as in claim 1, making the fluid-tight joint between the sections of the bell and spigot type joint and mounting a pair of circular gaskets on one face of the joint and forming a fluid-tight seal, forming conduits from the joint to the inside of the section and connecting them by another conduit to a pump mounted in the section, the pump on being activated dewatering the joint and allowing the pressure of the water on the end of the section to close the joint.

3. A method of constructing tunnels as in claim 1, making the fluid-tight joint between the sections of the spigot an socket type joint and placing circumferential gaskets in grooves on the outside of the spigot and on the outside of the inner lip of the socket and forming a fluid-tight seal, forming conduits from the joint to the inside of the section and connecting them by another conduit to a pump mounted in the section, the pump on being activated dewatering the joint and allowing the pressure of the water on the end of the section to close the joint.

4. A method of constructing tunnels as in claim 1, providing conduits between the surface of the water and the tunnel for inlet and exhaust of air and for supplying power and telephone service.

5. A method of constructing tunnels as in claim 1, using a traveling trench shore consisting of longitudinal panels which cover the walls of the trench completely and are supported by movable frames, the panels being moved forward by jacks connecting the panels to the frames which are held in place by the friction between the walls and other panels, the shore comprising a central working chamber with a front section with sides sloping to conform to the natural slope of the ground, and a rear section with similar sloping sides to allow for tamping and consolidating backfill material around the structure installed.

6. A method of constructing tunnels as in claim 2, using tunnel sections of the type described on the land approach to the under water tunnel and joining them together by pumping out the fluid-tight joints between the sections and allowing the pressure of the atmosphere on the end of the section to join them.

* * * * *